US012788203B2

(12) United States Patent
Becker et al.

(10) Patent No.: US 12,788,203 B2
(45) Date of Patent: Nov. 10, 2026

(54) MOP SYSTEM AND USE OF THE MOP SYSTEM

(71) Applicant: Hydroflex Group GmbH, Buseck (DE)

(72) Inventors: Edward Becker, Fernwald (DE); Olaf Barski, Frankfurt am Main (DE); Peter Nober, Rommersheim (DE); Maximilian Morgenstern, Mainz (DE)

(73) Assignee: Hydroflex Group GmbH, Buseck (DE)

( * ) Notice: Subject to any disclaimer, the term of this patent is extended or adjusted under 35 U.S.C. 154(b) by 401 days.

(21) Appl. No.: 18/693,900

(22) PCT Filed: Sep. 21, 2022

(86) PCT No.: PCT/EP2022/076203

§ 371 (c)(1),
(2) Date: Mar. 20, 2024

(87) PCT Pub. No.: WO2023/046738

PCT Pub. Date: Mar. 30, 2023

(65) Prior Publication Data

US 2025/0134341 A1 May 1, 2025

(30) Foreign Application Priority Data

Sep. 21, 2021 (DE) ..... 10 2021 124 441.2

(51) Int. Cl.
*A47L 13/42* (2006.01)
*A47L 13/254* (2006.01)

(52) U.S. Cl.
CPC ..... *A47L 13/42* (2013.01); *A47L 13/254* (2013.01)

(58) Field of Classification Search
CPC .... A47L 13/253; A47L 13/258; A47L 13/254; A47L 13/42
See application file for complete search history.

(56) References Cited

U.S. PATENT DOCUMENTS 5,483,720 A 1/1996 Decoopman et al.

FOREIGN PATENT DOCUMENTS

CN 221129808 U * 6/2024
DE 9207866 U1 8/1992
(Continued)

OTHER PUBLICATIONS

International Search Report for International Application No. PCT/EP2022/076203, mailing date Jan. 18, 2023, 2 pages. [English translation].

(Continued)

*Primary Examiner* — Shay Karls
(74) *Attorney, Agent, or Firm* — Seed Intellectual Property Law Group LLP

(57) ABSTRACT

A mop system includes a flat mop holder to hold a mop cover in a first state and to release the mop cover in a second state, and which comprises an actuating kinematic system for causing a change from the first state to the second state. A mop handle is connected at a first end to the flat mop holder, and an actuating member is arranged opposite to the first end on the mop handle. At least one cable pull is adapted and arranged to transmit an activating force and/or movement from the actuating member to the actuating kinematic system. A plurality of mop handle sections are telescopically adjustable relative to one another, wherein the cable pull includes a length compensation device to variably adjust the cable pull corresponding to a telescopic position of the mop handle sections.

15 Claims, 5 Drawing Sheets

(56) References Cited

FOREIGN PATENT DOCUMENTS

| | | | |
|---|---|---|---|
| DE | 694 01 468 | T2 | 7/1997 |
| DE | 202013011946 | U1 | 10/2014 |
| EP | 2 139 372 | B1 | 7/2016 |
| EP | 2 301 406 | B1 | 8/2017 |
| EP | 3 251 575 | A1 | 12/2017 |
| FR | 2 730 401 | A1 | 8/1996 |
| WO | 2013/166492 | A2 | 11/2013 |

OTHER PUBLICATIONS

International Search Report for International Application No. PCT/EP2022/076203, mailing date Jan. 18, 2023, 3 pages.
Written Opinion of the International Searching Authority for Application No. PCT/EP2022/076203, Jan. 18, 2023, 7 pages.

* cited by examiner

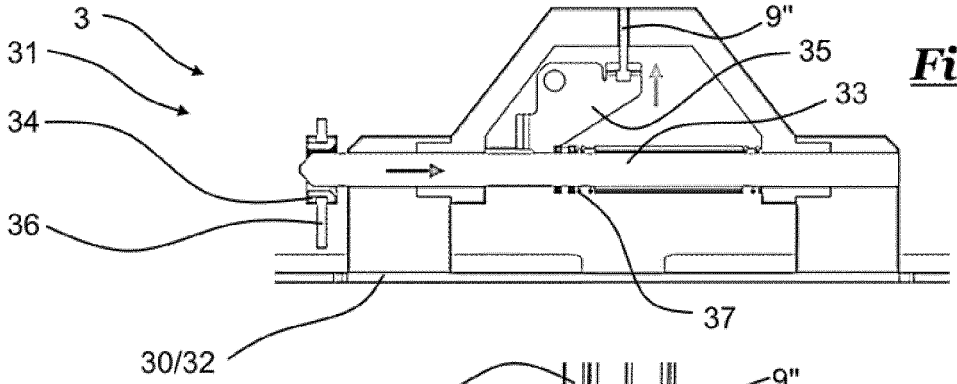
Fig. 3a
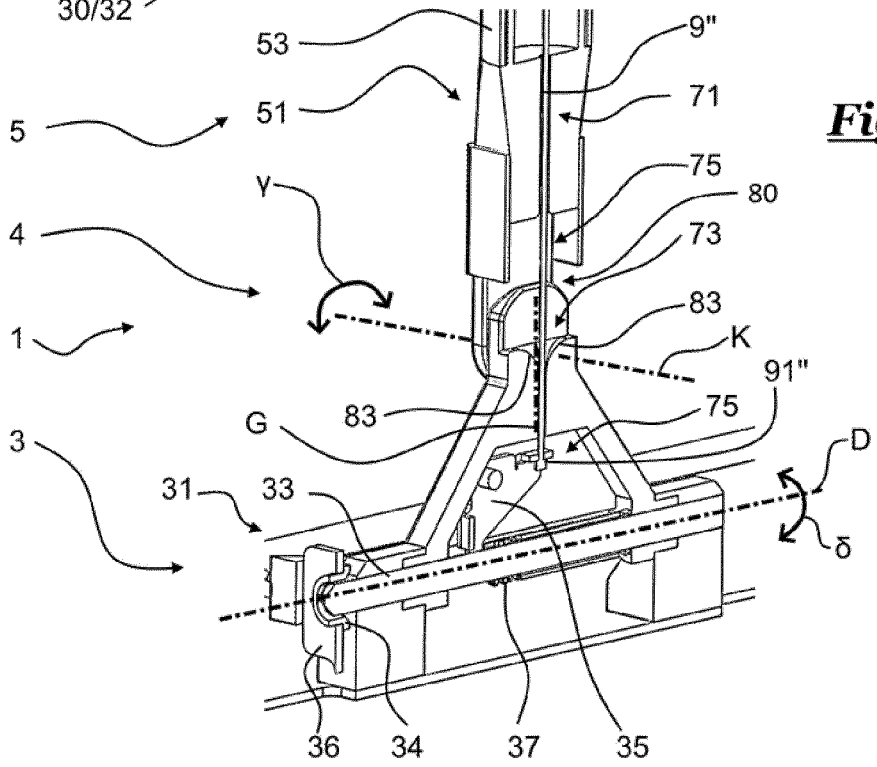
Fig. 3b
Fig. 2a
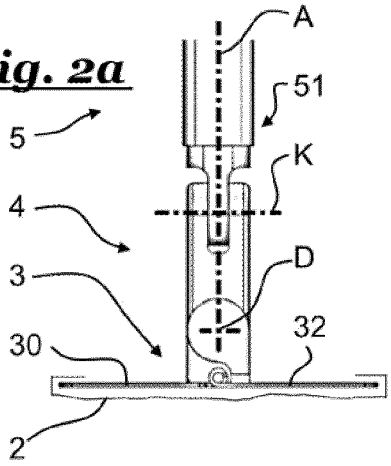
Fig. 2b
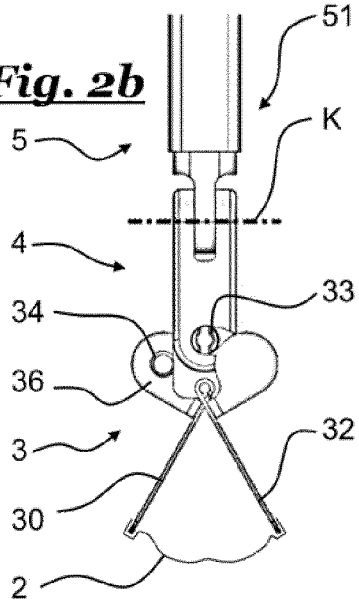

MOP SYSTEM AND USE OF THE MOP SYSTEM

BACKGROUND

Technical Field

The present disclosure relates to a mop system. According to the present disclosure, the use of the mop system is provided, for example, for cleaning, in particular floors, walls and/or ceilings, in preferably sterile clean rooms.

Description of the Related Art

Mop systems are used for cleaning floors or other surfaces in clean rooms. Working in clean rooms is accompanied by particular hygiene requirements. This relates to the objects and working processes that can be used, for example, in clean rooms. It is of primary importance to prevent the introduction of contaminants, such as particles and/or germs, into the clean room, as well as possible cross-contamination of clean objects by contaminants of other objects.

For mop systems and other working devices that are introduced into clean rooms, it generally applies that these must be decontaminatable and disinfectable, optionally even sterilizable, for example by autoclaving at 121° C. for up to 25 minutes or at 134° for up to 6 minutes. The mop systems must also be resistant to cleaning agents, disinfectants and/or solvents. Disinfectants comprise, for example, diamines, isopropanol, ethanol, active chlorine, hydrogen peroxide. Cleaning agents comprise, for example, alkaline cleaning agents, such as sodium hydroxide, and/or acidic cleaning agents. A solvent is, for example, acetone.

When cleaning clean rooms, it is of particular importance to make all necessary working steps as reproducible as possible. Furthermore, it has been found that, when working in clean rooms, the number of individual manual working steps should be kept as low as possible. Few individual working steps are advantageous in clean rooms, since particles are released into the clean room by the cleaning personnel and also by the equipment with each movement. Such a release of particles should be minimized as far as possible. Here, the correct use of the mop system by the cleaning personnel is of great importance. In conventional mop systems, the cleaning personnel often have to make considerable efforts for various working steps. Experience has shown that excessive physical stress on the cleaning personnel quickly leads to fatigue and demotivation. When cleaning clean rooms, the mop cover generally has to be replaced after each cleaning process, i.e., a large number of wiping mop covers are often required to clean a room. The mop covers are usually changed after 15-20 $m^2$. Manual contact with the mop by cleaning personnel is disadvantageous, since cross-contamination can occur. In this case, contamination can be transferred from a used mop cover to a user and from a user to a fresh mop cover or other objects in the clean room. This can lead to undesired contamination of the clean room. To avoid cross-contamination when using mop systems, fresh mop covers are received and used mop covers are discarded without manual contact. In addition, this avoids the cleaning personnel having to bend when receiving and/or discarding a mop cover.

A cleaning device for clean rooms in the form of a mop system, which comprises a shaft partial section, a closure element, and a holder for a mop cover, is described, for example, in DE 20 2013 011 946 U1. In the known cleaning device, a lever-like closure element is provided on the upper side of the holder for the mop cover. The holder is substantially rectangular and has a longitudinal extent which is greater than its width extent. The holder comprises two holding wings which are pivotable relative to one another. For cleaning, the closure element holds the holding wings in one plane, such that a flat mop cover can be placed flat on the lower side of the holder on a surface to be cleaned. The flat mop cover has pockets lying opposite one another in the longitudinal direction for receiving in each case one holding wing. If the closure element is released, the holding wings fold downward in the direction away from the mop handle, such that the holding wings slide out of the pockets of the mop cover and release the mop cover. The closure element on the upper side of the holder can be actuated by the cleaning personnel. DE 20 2013 011 946 U1 further describes a cleaning cart, to the frame of which a tuning fork-shaped release device is fastened. The cleaning device can be introduced into the release device and pulled upward, such that the tuning fork-shaped arms of the release device press against the closure element and release it in this way. The set of cleaning device and cleaning cart is outstandingly suitable for ergonomic clean room cleaning and is therefore very popular. However, there is the desire for a cleaning device, the closure element of which manages without additional release device on a cleaning cart or the like. Thus, for example, there is the desire for a system which manages without a cleaning cart and without a release device for particularly narrow, small or densely occupied clean rooms with working devices. Some users already dispense with cleaning carts and discard used flat mop covers into containers for later removal, wherein there is the desire to manage without a discarding aid, such as a release device.

EP 2 139 372 B1 and EP 2 301 406 B1 describe mop systems with a mop holder which is composed of a main part and grippers. The grippers are equipped with a large number of barb-like, angled projections or a hook-and-loop connection having hooks and eyelets on the lower side of the mop holder in order to cooperate with a flat mop cloth positioned there. The grippers can be moved back and forth in translation between different positions in the plane of the mop holder in order to grip and clamp the flat mop cloth by way of the projections or hook-and-loop connection or in order to release the flat mop cloth from the grippers. The grippers can be actuated, for example, in a conventional manner by a lever on or upper side of the mop holder. In addition, it is proposed to actuate the grippers by a rotation of the mop handle relative to the mop holder or by way of a pivot lever on the mop handle which can actuate a cable pull. However, it is found that the use of the mop handle itself, like the use of a lever, in many embodiments involves a risk of unintentional incorrect operation and an associated risk of contamination. In addition, levers interfere with the ergonomics during the handling of the mop system. They hinder the cleaning personnel during grasping and represent obstacles, for example, during the treatment of narrow gaps. Embodiments with lever or mop handle actuation are difficult to operate with only one hand. Furthermore, the use of pivot levers or of a rotatable mop handle produces additional abrasion on the pivot or rotation bearing, which is undesired in clean rooms. According to one alternative, an electronic button is provided on the mop handle which actuates an electric motor, a solenoid or another battery-operated electronic actuator on the mop holder. Electronic actuators and switches are very problematic with regard to the use of the mop system in the clean room and the suitability for autoclavability required for this. EP 2 301 406 B1 proposes, as a further alternative, the use of a rod mounted in the mop handle with a gearwheel or worm connection for actuating the grippers. The use of an actuating rod is accompanied by a significantly increased weight compared to conventional mop systems. The mounting of the mop holder on the mop handle is complicated and the mop holder can be separated from the mop handle only with difficulty, for example for individual transport, for maintenance or for cleaning. None of the mop systems described in EP 2 139 372 B1 and EP 2 301 406 B1 with actuation on the mop handle is suitable for use with a telescopic mop handle. The requirements for use in clean rooms meet the mop systems described in EP 2 139 372 B1 and EP 2 301 406 B1 only inadequately.

WO 2013 166 492 A2 describes another mop system with a multi-part, partially telescopic mop handle and a mop holder fastened thereto with grippers for a flat mop cloth. The grippers function substantially like those described in EP 2 139 372 B1 and EP 2 301 406 B1. The mop handle is composed of a multi-part first grip section and a telescopic second grip section. The first grip section is composed of a mop holder-side lower part and an upper part. The upper part of the first grip section can telescopically receive the second grip section. At the transition from the first to the second grip section, a threaded sleeve described with reference to FIG. 6 is arranged on the inside, which cooperates with a right-hand rotating thread on a rotating rod in order to fix or release the grip sections relative to one another. At the uppermost end of the second grip section, an end grip is provided which can be designed as a rotatable knob or with a button which can be pressed in transversely with respect to the longitudinal direction of the handle and with which the rotating rod can be actuated. As described with reference to FIG. 18, the first grip section is divided by a centrally arranged grip into the upper part, which receives the first grip section and the rotating rod, and the lower part. The lower part of the first grip section receives on the inside a pulling rod which is fastened to a translationally movable part of the grip in order to be raised together with the latter. In the connecting piece between mop handle and mop holder, a cable pull is provided, the cable holder of which can be fastened to the pulling rod, as FIGS. 8 and 9 show. The cable pull actuates the grippers. The mounting of the mop holder on the mop handle is complicated and the mop holder can be separated from the mop handle only with difficulty, for example for individual transport, for maintenance or for cleaning. When the first grip section is separated from the connecting piece, the cable holder can be released, fall out and even damaged. The mop system described is much heavier than conventional mop systems. The partial telescopicity permits height adjustability only to a small extent. The mop system is therefore poorly suitable for cleaning wall and ceiling surfaces in a clean room.

BRIEF SUMMARY

The present disclosure provides a device, a kit of parts, and a use method which can be used particularly easily, in particular with as few individual handling movements as possible, and/or with the application of as little force as possible by cleaning personnel.

Accordingly, a mop system is provided which comprises a flat mop holder which is adapted and arranged to hold a mop cover in a first state and to release the mop cover in a second state. The flat mop holder further comprises an actuating kinematic system for causing a change from the first state to the second state. The mop system comprises a mop handle which is connected or connectable to the flat mop holder at a first end. Arranged opposite the first end on the mop handle, in some cases at a second end of the mop handle, is an actuating member which is adapted and arranged to activate the actuating kinematic system. The actuating member is connected or connectable to the actuating kinematic system. By way of the actuating member it is possible to activate the actuating kinematic system which is arranged and adapted to cause the flat mop holder to change from the first state to the second state as a result of the activation by the actuating member. The connection of the actuating member to the actuating kinematic system can be, for example, mechanical, hydraulic, pneumatic, electronic or a combination of the aforementioned operating principles.

For example, the actuating kinematic system can comprise a blocking member which fixes the flat mop holder in the first state, and which blocking member releases the flat mop holder from the fixing in the second state, so that the flat mop holder is no longer held in the first state. In the second state, for example, the weight force of the mop cover can cause the mop cover to slide away from the flat mop holder. Alternatively or additionally, in the second state, for example, a spring or another actuator can cause a change in configuration of the flat mop holder, so that the mop cover can slide or is forced by the flat mop holder. The flat mop holder can have a rectangular basic shape. The flat mop holder can have a length in the range from 35 cm to 55 cm, in some cases in the range from 40 cm to 50 cm, and a width in the range from 8 or 10 to 20 cm, in some cases in the range from 12 cm to 17 cm.

According to at least one aspect of the disclosure, which can be combined with other aspects or embodiments, respectively, the actuating kinematic system has the actuating kinematic system (31) at least one first mop holding wing which is pivotable, in some cases along a longitudinal edge, relative to at least one second mop holding wing. In some cases, the actuating kinematic system can have at least two mop holding wings which are pivotable relative to one another, in some cases along their longitudinal edges. The first and/or the second mop holding wing can be rigidly fastened to the mop handle and/or an articulated connection. The flat mop holder can preferably have two holding wings which are pivotable relative to one another. In the first state, the flat mop holder tensions the flat mop cover in the plane. In the first state of the flat mop holder, the holding wings are held flat and/or in a plane. In the second state, the holding wings can fold downward away from the plane as a result of their weight force and the weight force of the flat mop cover, so that, for example, holding pockets of a flat mop cover which are turned over the holding wings slide down from the holding wings.

The mop handle can be divided roughly into three regions, namely a first end region close to the flat mop holder, which can be referred to as the lower end region, a second end region remote from the flat mop holder, which can be referred to as the upper end region, and a central region extending between the end regions. The actuating member can be arranged in the central region and/or at the second end region, in some cases on the outer circumference of the mop handle. The central region and the end region are usually the regions of the mop handle at which the cleaning personnel grip the mop system with the left hand or the right hand. For example, a mop handle can be adapted to be gripped with a first, left or right, hand in the central region. Alternatively or additionally, the mop handle can be adapted to be gripped in the second end region with a second, right or left, hand. The mop handle can be equipped with at least one grip section for gripping. A grip section can comprise a longitudinal section which is offset, in some cases raised or lowered, with respect to the rest of the mop handle. A grip region can be equipped, for example, with a shield, a knob, a bell, a rod or another anti-slip protection. A grip region can alternatively or additionally have a gripping aid, such as a rubberized and/or profiled surface. The actuating member is preferably arranged in the region of a first grip section or a second grip section. It is conceivable that two grip sections are each equipped with an actuating member. The actuating member is preferably adapted and arranged to be operable with one hand, in some cases with a finger, for example the thumb, in order to activate the actuating kinematic system. The actuating member preferably has a resetting and/or pretensioning mechanism which forces the actuating member into an inactive starting position in which the actuating member does not cause any activation of the actuating kinematic system. For example, the resetting and/or pretensioning mechanism can comprise a pretensioning spring which acts on the actuating member and counter to the actuating direction of the actuating member. The mop handle has a length of at least 100 cm, preferably in the range from 120 to 240 cm, in some cases in the range from 160 to 220 cm, preferably in the range from 180 to 200 cm.

According to at least one aspect of the present disclosure, which can be combined with other aspects and embodiments, the mop handle has at least one cable pull which is adapted and arranged to transmit an activating force and/or movement from the actuating member to the actuating kinematic system. For example, the cable pull can be movable at least in sections translationally downwards in the direction of the longitudinal axis of the mop handle, in the direction towards the mop holder, in order to activate the actuating kinematic system. Alternatively or additionally, the cable pull can be movable at least in sections translationally upwards in the direction of the longitudinal axis of the mop handle, away from the mop holder, in order to activate the actuating kinematic system. The movement of the cable pull is preferably caused by the actuating member. In some cases, the cable pull carries out a transmission movement which corresponds to a corresponding movement of the actuating member. Preferably, the actuating member is connected to the cable pull in a force-transmitting manner. The cable pull can be equipped with a pretensioning mechanism and/or a resetting mechanism which causes the cable pull to perform a resetting movement counter to the activating movement. For example, the cable pull can have a resetting spring which, following the activation, when the cable pull is not actuated or is no longer actuated by the actuating member, causes to return into a starting position. The pretensioning and/or resetting mechanism of the cable pull can additionally exert a resetting action on the actuating member.

The mop handle comprises a plurality of mop handle sections which are telescopically adjustable relative to one another, wherein in some cases the cable pull comprises at least one length compensation device, such as a cable pull follower, which length compensation device is adapted and arranged to variably adjust the cable pull corresponding to a telescopic position of the mop handle sections. The length compensation device allows the actuating kinematic system to be activated with the actuating member independently of the telescopic position of the mop handle. The mop system can have two or more mop handle sections. The length compensation device causes an adaptation of the cable pull to the telescopic position of the mop handle sections according to the operation, so that independently of the telescopic position of the mop handle sections relative to one another in each telescopic position the actuating member is in the layer to activate the actuating kinematic system. For example, two mop handle sections which are telescopically adjustable relative to one another can be realized by an outer mop handle section with an inner mop handle section held therein at least in sections. The length compensation device can be arranged for example on the inner mop handle section, preferably on the end of the inner mop handle section arranged in the interior of the outer mop handle section. The length compensation device can have a deflection mechanism, for example a deflection edge or a deflection pulley, for the cable pull. For example, the cable pull can be held on a first and/or a second mop handle section which are movable relative to one another and/or can be mounted such that the length compensation device undergoes a corresponding displacement in the event of a change in length of the telescopic mop handle, so that the cable pull is adapted to the respective telescopic position. With the aid of the length compensation device, accidental activation of the actuating device in the event of a length adjustment of the telescopic mop handle is avoided.

The mop handle comprises at least one retracted configuration in which the mop handle is retracted to a minimum mop handle telescopic length. The minimum mop handle telescopic length is in some cases in the range of 120 cm±25 cm, preferably in the range of 121±10 cm. The mop handle comprises at least one extended configuration in which the mop handle is extended to a maximum mop handle telescopic length. The maximum mop handle telescopic length is in some cases in the range of 180 cm±25 cm, preferably in the range of 181±10 cm. The extension range, i.e., the cumulative range of the length adjustability of the mop handle, is in some cases in the range of 50 cm to 100 cm, preferably in the range of 60 cm to 80 cm, particularly preferably 70 cm.

The mop system is telescopic. In some cases, the mop system comprises at least one retracted configuration in which the mop system is retracted to a minimum mop handle telescopic length. The minimum telescopic length is in some cases in the range of 100 cm to 190 cm, preferably in the range of 120 cm to 160 cm, particularly preferably in the range of 140 to 150 cm. A preferred minimum telescopic length of the mop system is 145. The mop system comprises at least one extended configuration in which the mop system is extended to a maximum telescopic length. The maximum telescopic length is in some cases in the range of 140 cm to 250 cm, preferably in the range of 180 cm to 220 cm, particularly preferably in the range of 205 cm to 215 cm. A preferred maximum telescopic length of the mop system is 210. It is clear that the minimum telescopic length is less than the maximum telescopic length. Due to the large range of telescopicity, ceiling surfaces can also be treated particularly ergonomically.

An outer mop handle section preferably has a length in the range of 950 cm±25 cm, in some cases in the range of 950 cm±10 cm. The outer mop handle section is preferably tubular. An inner mop handle section preferably has a length in the range of 100 cm±25 cm, in some cases in the range of 101 cm±10 cm. The inner mop handle section is preferably tubular. An inner, tubular mop handle section can receive a structural reinforcement. The structural reinforcement can be formed for example by a foam, such as a metal foam or a polymer foam, wherein in some cases the foam predominantly, i.e., at least 50%, in some cases at least 75%, preferably at least 90%, or completely fills the tubular inner mop handle section.

According to a further development of the mop system, a guide is arranged in an inner cavity of the mop handle. The mop handle can preferably be formed tubular, in some cases with an at least in sections round and/or polygonal cross section. In some cases, the mop handle completely surrounds the guide. The guide can be formed at least in sections in functional union with an inner side of the mop handle. The arrangement of the guide and the cable pull arranged therein in the interior of the mop handle protects on the one hand the cable pull from damage and on the other hand the clean room from particle contamination. Preferably, the guide with the cable pull is arranged completely within the mop handle, in an inner cavity of the mop handle.

According to a preferred further development of the mop system, the cable pull comprises at least one pull cable and at least one deflection mechanism. A deflection mechanism can be, for example, a deflection pin or a deflection pulley. The at least one pull cable is generally guided along the deflection mechanism in order to change the pulling direction of the pull cable, for example by an angle in the range of 45° to 275°, preferably in the range of 180°+20° or in the range of 90°+10°. The cable pull can comprise more than one pull cable. For example, different sections can be formed by different pull cables of a cable pull. A plurality of pull cables can be connected to one another for example by releasable couplings. The cable pull can have, for example, a first deflection mechanism at the lower end of the mop handle. Additionally or alternatively, the cable pull can have a second deflection mechanism at the upper end of the mop handle, in some cases at the actuating member. Alternatively or additionally, the cable pull can have in some cases a further deflection mechanism at one end of a mop handle section, which is located within another mop handle section. A cable pull forms a particularly light transmission mechanism and is therefore well suitable for cleaning wall and/or ceiling surfaces in a clean room. Furthermore, the cable pull advantageously offers the possibility of adjusting an actuating force at the actuating member, which is lower than the activating force required for activating the actuating kinematic system. In this way, particularly smooth handling of the actuating member can be realized with little force.

In some cases, the cable pull of the mop system comprises a first pull cable which extends, in some cases in an inner cavity of the mop handle, from the first end to the actuating member, in some cases at the opposite second end of the mop handle. Optionally, the first pull cable can extend from the actuating member to the actuating kinematic system. In that a cable pull is used for force transmission from the actuating member at the second end to the opposite first end of the mop handle, a significant weight saving can be achieved compared to other mop systems with actuation on the mop handle. The mop system with a pull cable which extends from the first end of the mop handle to the actuating part can be realized particularly easily and consequently easy to handle by cleaning personnel. As a result, a mop system can be realized which has a manual actuation at the end of the mop system lying opposite the mop holder, which can be handled particularly ergonomically and in a manner suitable for clean rooms.

In a preferred embodiment of a mop system with a cable pull and a length compensation device, the length compensation device comprises a cable pull center runner. The cable pull center runner comprises a deflection mechanism fastened to the end of an inner mop handle section, which adjusts a compensation length of the pull cable between this deflection mechanism and a first end of the pull cable corresponding to an inserted length of the inner mop handle section within the outer mop handle section. The deflection mechanism of the cable pull center runner can preferably be a further deflection mechanism which is arranged at the inner end of an inner mop handle section.

According to an embodiment of the mop system, the mop system comprises an articulated connection, in some cases comprising a pivot-tilt joint, by way of which articulated connection the first end of the mop handle is connected or connectable to the flat mop holder. In some cases, the cable pull comprises at least one angle compensation device, such as a pull cable support curve, which is adapted and arranged to adjust the transmission of the activating force and/or movement from the actuating member to the actuating kinematic system independently of an inclination between the mop handle and the mop holder. For example, for a cable pull, the articulated connection can be equipped with a pull cable support curve which has a preferably curved sliding surface, along which sliding surface a pull cable of the cable pull can be guided in a predetermined inclination range of the mop handle relative to the mop holder. In some cases, the angle compensation device is arranged and adapted to counteract a change in length of the cable pull as a result of an inclination of the mop handle relative to the mop holder. Preferably, the angle compensation device is arranged to provide, in the case of a pivot-tilt joint, an angle compensation with respect to precisely one partial joint, for example the rotary joint or the tilt joint, wherein in some cases the angle compensation device is arranged on the mop handle-side partial joint. It has been shown that, in some embodiments of mop systems with a cable pull and without an angle compensation device, a change in the inclination between the mop handle and the mop holder can lead to impairment of the functionality of the actuating kinematic system. In an unfavorable inclination angle, the actuating kinematic system has sometimes been activated without having been caused to do so by the actuating member. In another unfavorable inclination angle, no activation of the actuating kinematic system took place despite intended activation by the actuating member.

In a preferred embodiment of a mop system which comprises a cable pull and an articulated connection with an angle compensation device, the angle compensation device has at least one pull cable support curve. The pull cable support curve can be adapted and arranged to guide the at least one pull cable at least in sections centrally in the articulated connection, in some cases coaxially to an articulated longitudinal axis. Alternatively or additionally, the pull cable support curve can laterally support the at least one pull cable in the region of the rotational and/or tilt axis counter to a rotational and/or tilt inclination of the mop handle. A lateral support can be realized, for example, by a rounded sliding contour of the pull cable support curve.

In a preferred further development, the articulated connection of the mop system has a releasable actuating coupling which connects the actuating member to the actuating kinematic system in a force-transmitting manner. It can be preferred that the flat mop holder and/or the mop handle is releasable from the articulated connection. Alternatively or additionally, the flat mop holder or the mop handle can be firmly connected to the articulated connection, in some cases in a substance-bonded or material-bonded manner, preferably in a non-destructively separable manner. Particularly preferably, a releasable actuating coupling is provided corresponding to a releasable connection of the articulated connection to the mop handle or the flat mop holder. In an articulated connection which is releasable from the flat mop holder or the mop handle, the releasable actuating coupling allows a reversible releasability and connectability of the actuating member, in some cases also of the cable pull, and the actuating kinematic system to one another. The articulated connection and/or the actuating coupling can comprise a bayonet connection. Preferably, the articulated connection and the actuating coupling are matched to one another in such a manner that the fastening of the mop handle or the flat mop holder is accompanied immediately by a force-transmitting connection of the actuating coupling for connecting the actuating member to the actuating kinematic system at the articulated connection.

According to an embodiment of a mop system with a releasable actuating coupling and a cable pull which comprises at least one (first) pull cable, the cable pull also comprises a second pull cable. The second pull cable differs from the first pull cable. The second pull cable can extend in the mop holder and the articulated connection. In some cases, the second pull cable connects the actuating coupling to the actuating kinematic system in a force-transmitting manner. It can be preferred that the mop system has a first pull cable which connects a first coupling part of the actuating coupling to the actuating member, and a second pull cable which connects a second coupling part of the actuating coupling to the actuating kinematic system. The actuating coupling is preferably releasable in such a manner that the first coupling part is reversibly separable from the second coupling part and/or that the first coupling part is reversibly connectable to the second coupling part. The first coupling part and the second coupling part can form, for example, a cooperating claw coupling In a preferred embodiment of a mop system with a cable pull and a releasable actuating coupling, the actuating coupling comprises at least one deflection mechanism which is arranged at the first handle end and carries a coupling plate or a sliding block (first coupling part). Preferably, the deflection mechanism cooperates with the first pull cable. The deflection mechanism can be in some cases a first deflection mechanism of the cable pull. The actuating coupling comprises in some cases a return spring which forces the sliding wedge or the coupling plate in the direction of the first handle end.

According to a further development, the articulated connection comprises a (second) coupling part which is connected on the one hand to the actuating kinematic system and which is connectable or connected on the other hand releasably to the coupling plate or to the sliding wedge (first coupling part) in order to transmit the activating force and/or movement from the actuating member to the actuating kinematic system. Preferably, the second coupling part is connected to the actuating kinematic system by way of the second pull cable.

According to a preferred embodiment, the actuating coupling is arranged in an articulation interior. The articulation interior can be surrounded for example by a sleeve-shaped collar of the articulated connection, into which collar a first end of the mop handle can be introduced. Alternatively or additionally, it is conceivable that the mop handle has at its first end a receptacle into which a section of the articulated connection can be introduced at least partially, and in which receptacle the actuating coupling is arranged when the mop handle is connected to the articulated connection. Since the articulated connection provides a protected articulation interior, within which a connection for transmitting the activating force and/or movement between the actuating member and optionally the cable pull on the one hand and the actuating kinematic system on the other hand is arranged in an articulation interior, the actuating coupling is protected from interfering external influences and the risk of the release of particles is minimized.

According to a further development, the articulated connection has a snap-in connection, in some cases a bayonet connection, which is adapted and arranged to connect the mop handle to the flat mop holder in a releasable manner. The snap-in connection can be provided between the articulated connection and the flat mop holder. Alternatively or additionally, the snap-in connection can be provided between the articulated connection and the mop handle. For example, the articulated connection can have a snap-in connection in the form of a collar with L-shaped recesses and the first end of the mop handle with lugs which are complementary in shape to the recesses of the articulated connection and which together realize a bayonet connection. Additionally or alternatively, a snap-in connection can have a spring pretensioned fixing pin for holding the flat mop holder or the mop handle in a fixed manner on the articulated connection and a fixing pin receptacle which is complementary in shape to the fixing pin. For example, the fixing pin receptacle can be formed in the mop handle, and a fixing pin which is spring pretensioned in the transverse direction can be arranged on the articulated connection and which, when the mop handle is plugged onto the articulated connection, releasably snaps into the fixing pin receptacle in order to fasten the mop handle and the articulated connection to one another or to secure a fastening, for example by way of a bayonet connection.

According to a preferred embodiment of the mop system, the actuating member comprises a push button, in some cases on a grip section, preferably on a handle, of the mop handle, preferably on a second end of the mop handle opposite the first end of the mop handle. A push button is advantageous for particularly easy operability of the mop system. The actuating direction of the push button can be oriented transversely to the longitudinal axis of the mop handle, in some cases radially. Preferably, the actuating direction of the push button corresponds to the longitudinal axis of the mop handle, in some cases parallel, preferably coaxially.

In a preferred embodiment of a mop system with a cable pull and a push button, the push button is preferably firmly connected to a second end of the pull cable. A second deflection mechanism is arranged in the region of the push button. The second deflection mechanism in the region of the push button can be adapted and arranged to convert a longitudinal movement of the push button with the end of the pull cable into another, in some cases opposite, pull cable section movement. For example, the push button can be pressed in the direction of the mop holder and the deflection mechanism can cause a pull cable section to be moved away from the mop holder in the opposite direction. The second deflection mechanism in the region of the push button can be fastened to a handle and/or the mop handle, in some cases the second and/or outer mop handle section.

According to a preferred embodiment of a mop system, the mop handle, preferably in the region of a grip section, in some cases a handle, and/or in a central region of the mop handle or a second end region of the mop handle, has at least in sections a rounded outer contour, in some cases a spherical knob. The actuating member is adapted in shape to the rounded outer contour. Preferably, the grip section and the actuating member form in a latching state a common rounded surface, such as a cylindrical surface or a spherical surface. With the aid of an actuating member adapted in shape to a rounded outer contour, unintentional activation can be avoided. In particular in the case of an embodiment with a spherical knob formed at the second end of the mop handle with an actuating member arranged therein, the shape-adapted outer contour advantageously causes the ergonomic holding of the mop system at the grip region to be unimpaired by the actuating member, for example when cleaning a ceiling surface.

According to a preferred embodiment of a mop system, the actuating kinematic system comprises at least one mechanical latch, such as a translationally movable latching pin and/or a rotationally movable rotary latch. For example, the actuating kinematic system comprises at least one latching pin which moves in or out relative to a receptacle when activating the actuating kinematic system, in order to cause the flat mop holder to change from the first state, in which the flat mop holder is arranged and adapted to hold a mop cover, to the second state, in which the flat mop holder releases the mop cover. Alternatively or additionally, the actuating kinematic system comprises a rotationally movable rotary latch, such as a scissor mechanism, which slides in or out when activating the actuating kinematic system, in order to cause the flat mop holder to change from the first state to the second state.

In a preferred embodiment, which can be combined with others, the mop system has at least one releasable magnetic force coupling between the actuating member and the actuating kinematic system, wherein in some cases the actuating kinematic system or optionally the actuating coupling comprises the magnetic force coupling. The magnetic force coupling can have a first, mop holder-side and a second, mop handle-side magnetic and/or magnetizable coupling part, which can be connected to one another. It can be preferred that when the magnetic and/or magnetizable coupling parts are released from one another, the actuating kinematic system is caused to change from the first to the second state. Alternatively or additionally, a magnetic force coupling can be provided as part of the actuating kinematic system. For example, the mop holder can comprise at least one mop holding wing which is mounted movably relative to another part of the mop holder, for example another mop holding wing. For use of the mop system according to the operation, the magnetic force coupling can be arranged to hold the mop holding wing or wings in a flat position, in which the mop holder can carry or carries a flat mop cover. By releasing the magnetic force coupling, the mop holding wing or wings can be released from the flat position, in order, for example by a spring tension and/or the dead weight of the mop holding wing or wings, to assume a folded position, in which a flat mop cover is released from the mop holder and/or in which the mop holder can be introduced into a flat mop cover. For example, the at least one mop holding wing can have a magnetic or magnetizable force partner which is adapted and arranged to cooperate with a magnetic or magnetizable counter force partner. The actuating kinematic system can be realized and arranged, as a result of an actuation by the actuating part, to be caused to remove the counter force partner from the force partner, in some cases translationally or rotationally, for example in transverse direction relative to a magnetic main force direction.

It can be preferred that the mop holder, in some cases the flat mop holder, and/or the mop handle comprises or consists of carbon fiber reinforced plastic. The mop holder has a weight of at most 450 g, in some cases at most 300 g, preferably at most 200 g or at most 150 g. In some cases, the mop holder comprises at least 50%, at least at least 60%, or at least 80% or at least 95% carbon fiber reinforced plastic (CFRP), preferably at least 90% carbon fiber reinforced plastic, particularly preferably at least 95% carbon fiber reinforced plastic. The proportion of the carbon fiber reinforced plastic is determined in some cases in relation to the surface of the mop holder, preferably the surface of the side of the mop holder to be directed toward the floor. It should be clear that the proportion of fiber reinforced plastic of the mop holder does not take into account a connecting piece, realized in some cases by an articulated connection, for connecting mop holder and mop handle to one another. Alternatively or additionally, the mop system can have a total weight that is in the range of 400 g to 800 g, in some cases in the range of 500 g to 700 g, preferably in the range of 580 g to 680 g. In that the mop holder is formed in a weight-saving manner, for example, with carbon fiber reinforced plastic material, a particularly effective work facilitation for the cleaning personnel can be provided. The mop holder can comprise a plurality of mop holder parts, in some cases mop holding wings, which are movable relative to one another. The mop holding wings can be transversely foldable along a pivot axis in the mop width direction or longitudinally foldable along a pivot axis in the mop longitudinal direction.

According to at least one embodiment, the mop holder can be realized as a flat mop holder with a first mop holding wing and a second mop holding wing. Preferably, the mop holding wings each have a wing upper side and a wing lower side. The mop holding wings have two transverse edges lying opposite one another and two longitudinal edges lying opposite one another, wherein in each case one outer longitudinal edge points away from the other mop holding wing. The mop holding wings can in some cases have inner longitudinal edges which point towards one another. The longitudinal edges of a mop holding wing are longer than the transverse edges thereof. Preferably, the longitudinal extent of the longitudinal edges of the mop holder is greater than the transverse width of the mop holder. The transverse width of the mop holder can be defined by the cumulative transverse width of the transverse edge of the first mop holding wing and the transverse edge of the second mop holding wing. Preferably, the mop holder and/or the mop holding wings have a substantially rectangular basic shape. The longitudinal extent of the flat mop holder can correspond to the respective longitudinal extent of the first and/or the second mop holding wing. The longitudinal extent of the mop holder can be in the range of 35 to 55 cm, in some cases in the range of 45 to 50 cm, preferably at approximately 48 cm. Additionally or alternatively, the width of the mop holder can be in the range from 8 or 10 to 20 cm, in some cases in the range of 12 to 17 cm, preferably at approximately 14.5 cm. At least one of the two mop holding wings is movable relative to the other mop holding wing. Preferably, the second mop holding wing can be pivotable relative to the first mop holding wing and a connecting piece fastened or fastenable to the first mop holding wing. It can be preferred that one of the mop holding wings, in some cases the second mop holding wing, is pivotable relative to the other mop holding wing about a longitudinal axis of the flat mop holder.

According to another aspect of the disclosure, which can be combined with one or more of the above, a mop handle is provided for a mop system in some cases for cleaning clean rooms consisting of or comprising carbon fiber reinforced plastic. It can be preferred that the mop handle comprises carbon fiber reinforced plastic. A mop handle can be formed at least in sections with or from carbon fiber reinforced plastic. It is conceivable that a mop handle has one or more carbon fiber reinforced plastic layers. Alternatively, it can be preferred that the mop handle consists of carbon fiber reinforced plastic. The mop handle has a weight of at most 800 g, in some cases at most 600 g, preferably at most 500 g or at most 400 g. In some cases, the mop handle comprises at least 50%, at least 60%, or at least 80% carbon fiber reinforced plastic, preferably at least 90%, particularly preferably at least 95% carbon fiber reinforced plastic, in some cases in relation to the area of the surface of the mop handle or the length of the mop handle in the longitudinal axis direction thereof. The mop handle, which can also be referred to as a shaft, makes up a large part of the weight of a conventional mop system. By using a carbon fiber reinforced plastic instead of the usual stainless steel or thick-walled plastic embodiments, a considerable weight reduction can be achieved. The use of a mop handle consisting of or comprising carbon fiber reinforced plastic allows the use of the mop system in some cases for cleaning walls and/or ceilings for longer periods of time with lower physical stress. Surprisingly, it has been found that carbon fiber reinforced plastic has material properties which allow use for cleaning clean rooms.

According to at least one embodiment, the mop holder, a connecting piece, and/or the mop handle comprises a plastic material, in some cases selected from a group consisting of thermosets, preferably epoxy resins, thermoplastics and mixtures thereof. Thermoplastics can preferably be selected from a group consisting of polyamides (PA), polyolefins, preferably polypropylene (PP), polyetherimides (PEI), polysulfones (PSU), polyether ether ketone (PEEK), polyacetals, preferably polyoxymethylene (POM), polyvinylidene fluoride (PVDF), polyphenylene sulfone (PPSU), polyether sulfone (PES), polyamide imide (PAI), polybenzimidazole (PBI) and mixtures thereof. The mop system can comprise different plastic materials. For example, a fiber reinforced, in some cases carbon fiber reinforced, mop holder or mop handle section can comprise a first plastic material, in some cases as matrix material. The mop system can comprise a different, second, third and/or further plastic material. In some cases, a handle of the mop system can comprise or consist of a second plastic material. In some cases, a connecting piece of the mop system can comprise or consist of a third plastic material. In some cases, a locking device of the mop system can comprise or consist of a fourth plastic material. The plastic material of the connecting piece, the locking device and/or the handle is in some cases a thermoplastic, preferably selected from a group consisting of polyamides, polyolefins, preferably polypropylene, polyetherimides, polysulfones, polyether ether ketone, polyacetals, preferably polyoxymethylene, polyvinylidene fluoride, polyphenylene sulfone, polyether sulfone, polyamide imide, polybenzimidazole and mixtures thereof. The plastic material of the connecting piece, the locking device and/or the handle can particularly preferably be POM, POM-GF (glass fiber reinforced POM), PA-GF (glass fiber reinforced PA), PP mineral reinforced (in some cases talcum reinforced), PEI, PSU or PEEK.

According to an embodiment, the mop handle comprises at least one tubular mop handle section. A mop handle section can also be referred to as a shaft partial section. The mop handle section has a weight of at most 400 g, in some cases at most 300 g, preferably at most 200 g or at most 150 g. The tubular mop handle section can comprise or consist of carbon fiber reinforced plastic. A mop handle section can be formed at least in sections with or from carbon fiber reinforced plastic. It is conceivable that a mop handle section has one or more carbon fiber reinforced plastic layers. In some cases, the tubular mop handle section has a wall thickness in the range of 0.01 mm to 3 mm. The tubular mop handle section preferably has a wall thickness of at most 1 mm, in some cases at most 0.5 mm, preferably less than 0.3 mm. The wall thickness of the tubular mop handle section can be at least 0.05 mm or at least 0.1 mm.

The carbon fiber reinforced plastic comprises or consists of a matrix material and a fiber material. The matrix material comprises or consists of thermosets and/or thermoplastics, in some cases epoxy resins, polyester resins, vinyl ester resins or mixtures thereof. The fiber material comprises or consists of carbon fibers, in some cases carbon nanotubes. The carbon fiber reinforced plastic can have a density in the range of 1.5 to 1.6 g/cm$^3$, in some cases in the range of 1.53 to 1.58 g/cm$^3$, preferably about 1.55 g/cm$^3$. The mop handle, the mop holder, the connecting piece and/or other components of the mop system can each be manufactured, for example, by hand lamination, in some cases in combination with vacuum pressing, autoclave methods, injection methods, in some cases resin transfer molding or reaction injection molding, winding methods or pressing methods, in some cases hot pressing methods, wet pressing methods or prepreg methods. In some cases, the mop handle, the mop holder, the connecting piece and/or another component of the mop system, which comprises or consists of carbon fiber reinforced plastic, can have a wall thickness in the range of 0.01 mm to 3 mm, preferably a wall thickness of at most 1 mm, more preferably at most 0.5 mm, particularly preferably less than 0.3 mm. In some cases, the carbon fiber reinforced plastic comprises at least 50% carbon fiber, preferably between 60% and 80% carbon fiber, particularly preferably about 70% carbon fiber. In addition, the fiber reinforced plastic comprises not more than 50% matrix material, preferably between 20% and 40% matrix material, particularly preferably about 30% matrix material. The proportions can be based on wt. %. It can be preferred that the fiber reinforced plastic has a twill fabric, in some cases a 2×2 twill fabric, such as a 3 k twill 2×2. The fiber material can preferably have a fiber diameter of not more than 0.5 mm, preferably not more than 0.3 mm, particularly preferably a fiber diameter of 0.2 mm, and/or a fiber diameter of at least 0.1 mm. The fiber reinforced plastic material, in some cases the carbon fiber reinforced plastic material, can be formed in some cases from a prepreg material in the form of (carbon) fiber plates or a (carbon) fiber tube. The prepreg material can have unidirectional fiber layers. The prepreg material can comprise prepreg fabric layers. In some cases, a prepreg material layer has a thickness of at least 0.03 mm, preferably at least 0.075 mm, and/or not more than 0.3 mm, preferably not more than 0.2 mm or not more than 0.15 mm. The (carbon) fiber material is formed from at least one prepreg material layer, in some cases at least two prepreg material layers, and/or not more than 15 prepreg material layers, preferably not more than 11 prepreg material layers, particularly preferably not more than four prepreg material layers.

According to a preferred embodiment, (a) the mop holder, the connecting piece and/or the mop handle comprise a plastic material, in some cases from the group consisting of thermosets, preferably epoxy resins, thermoplastics and mixtures thereof, (b) the mop holder, in some cases the flat mop holder, and/or the mop handle comprise carbon fiber reinforced plastic, (c) the at least one pull cable comprise a liquid crystalline polypropylene, and/or (d) the mop system, in some cases at least one movable, in some cases rotationally movable, component, stainless steel and/or silicone. It can be preferred that the mop holder and/or the mop handle consist at least in sections of carbon fiber reinforced plastic. In some cases, the at least one pull cable can consist of a liquid crystalline polymer. In some cases, the pull cable can be spun from a liquid crystalline polymer. The liquid crystalline polymer can be in some cases an aromatic polyester. The pull cable can comprise or consist of, for example, the material marketed under the trade name Vectran or Vectaline™, respectively. It can further be preferred that at least one movable, in some cases rotationally movable, component, such as a joint component, for example a joint pin or the like, consists of stainless steel. In some cases, at least (a) and (b), (a) and (c), (a) and (d), (b) and (c), (b) and (d), and/or (c) and (d), or at least (a) and (b) and (c), (a) and (b) and (d), (a) and (c) and (d), or (b) and (c) and (d), are realized in the mop handle. It can be preferred that the mop handle is realized according to (a), (b), (c) and (d). Such a mop handle can be suitable for ergonomic handling in a clean room due to particularly good suitability.

According to an embodiment, which can be combined with the above, the mop system is heat resistant up to at least 100° C., in some cases 120° C., preferably 140° C. In some cases, the mop system is adapted and arranged for autoclaving at 121° C. for up to 25 minutes or 134° for up to 6 minutes. Alternatively or additionally, the mop system is resistant to cleaning agents, solvents and/or disinfectants, in some cases selected from a group consisting of surfactants, acids, bleaching agents, enzymes, alcoholic solutions and mixtures thereof.

According to the present disclosure, it is provided that the mop system, which is realized in some cases as described above, is used for cleaning floors, walls and/or ceilings, in some cases in preferably sterile clean rooms.

According to the present disclosure, it can be provided that the mop system described above is part of a kit of parts, which further comprises at least one flat mop cover, in some cases a plurality of flat mop covers.

BRIEF DESCRIPTION OF THE SEVERAL VIEWS OF THE DRAWINGS

Further features and advantages of the present disclosure result from the following description, in which preferred embodiments of the disclosure are explained by way of example with reference to schematic drawings. In the drawings:

FIG. 2*a* shows a flat mop holder in a first state;

FIG. 2*b* shows the flat mop holder according to FIG. 2*a* in a second state;

FIG. 3*a* shows a detailed section of an actuating device;

FIG. 3*b* shows a perspective sectional view of the actuating device according to FIG. 3*a;*

Figure 1:
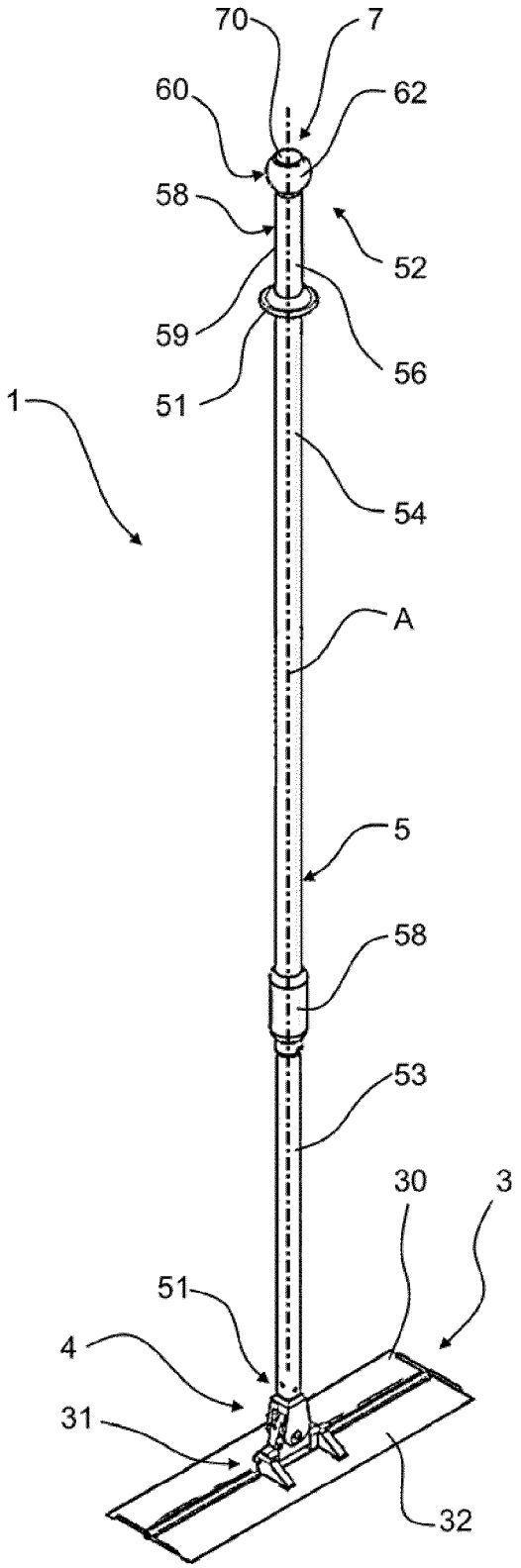
FIG. 1 shows a perspective representation of a mop system.

In the following description of various preferred embodiments with reference to the accompanying figures, the same or similar reference signs are used for easier readability for the same or similar components.

DETAILED DESCRIPTION

A mop system is generally provided with the reference sign 1. The mop system 1 comprises as essential components a flat mop holder 3 with an actuating kinematic system 31 and a mop handle 5 with an actuating member 7.

FIG. 1 shows a perspective representation of an embodiment of a mop system 1. In the embodiment illustrated, the mop system 1 has at its first end a flat mop holder 3 which is composed of two holding wings 30, 32 which are pivotable relative to one another.

The flat mop holder 3 of the mop system 1 is illustrated in FIG. 1 in a first state, in which the flat mop holder 3 can hold a (not illustrated) mop cover. FIG. 2*a* also shows the first state of the flat mop holder. In the first state of the flat mop holder 3, the holding wings 30 and 32 form a flat plane, onto which a flat mop cover 2 can be pulled in order to wipe a floor, wall or ceiling surface with the flat mop cover 2. FIG. 2*b* shows the flat mop holder 3 in a second state. In the embodiment illustrated by way of example in the figures, the second state is realized, in which the mop holding wings 30, 32 are pivoted relative to one another along their rear edges. In the second state of the mop holder 3, the flat mop cover 2 is released from the mop holder 3 and, as illustrated here, can slide off the mop holding wings 30 and 32.

The mop holder 3 comprises an actuating kinematic system 31 which causes the flat mop holder 3 to change from the first to the second state. FIGS. 3*a* and 3*b* show an exemplary embodiment of an actuating kinematic system 31 with an adjustable latch 33. In the first state, the flat mop holder 3 is held by a latching device. The latching device comprises for example a linearly movable latch 33 which engages in a pairing 34 on a flange section 36 of one or more mop holding wings 30, 32. The actuating kinematic system 31 is arranged to force the latch 33 out of the latching position illustrated in FIG. 3*b* when it is activated. When the actuating kinematic system 31 is activated, it forces the latch 33 out of the recess 34 so that the mop holding wing 30, 32 can move freely from the latching device. As a result of their own weight, the mop holding wings 30, 32 fold into the second state illustrated in FIG. 2*b*.

The mop holder 1 comprises a mop handle 5, the first end 51 of which is connected to the flat mop holder 3. Arranged at the opposite second end 52 of the mop handle is an actuating member 7 with which the actuating kinematic system 31 can be activated. In the exemplary embodiment illustrated in FIG. 1, the actuating member 7 is realized as a push button 70. The actuating member 7 is arranged on a handle 59 of the mop handle 5.

Figure 4:
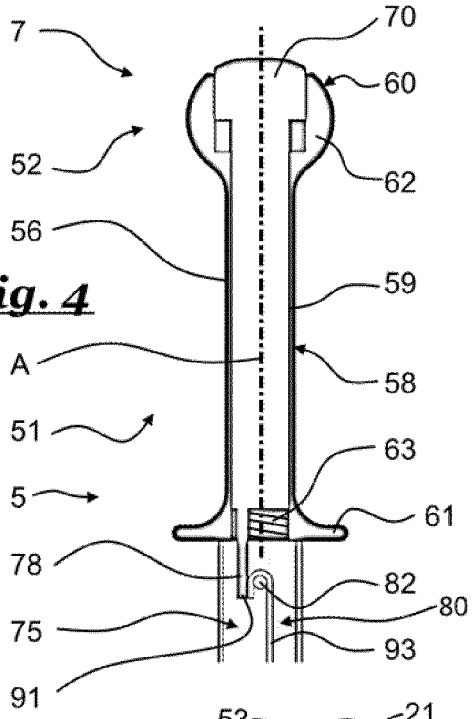
FIG. 4 shows a detailed section of a second end section of a mop handle with handle and actuating button.
Figure 6:
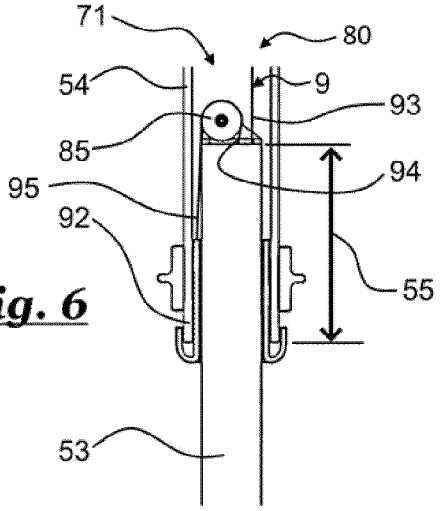
FIG. 6 shows a detailed view of a telescopic mop handle with a central runner.

FIG. 4 shows the handle 59 in detail. In the illustrated embodiment, the handle 59 has a cylindrical grip section 56 and a spherical knob 62. In the region of the grip section 56, the handle 59 has a cylindrical rounded outer contour 58. In the region of the knob 62, the handle in the illustrated embodiment has a spherical rounded outer contour 60. The push button 70 is formed with a rounded outer contour adapted in shape to the spherical shape of the knob 62. At the mop holder-side end of the handle 59, a shield 61 is provided as anti-slip protection.

The push button 70 can be actuated by being pressed in in the direction of the longitudinal axis A of the mop handle 5. The actuating movement of the actuating member 7 is transmitted to the mop holder 3 and activates the actuating kinematic system 31. In order that the push button 70 returns into its starting position after the flat mop cover 2 has been released, a resetting spring 63 is provided. The resetting spring 63 forces the push button 70 into its starting position. Handle 59 and push button 70 can be formed from an autoclavable material such as PEI.

Figure 5:
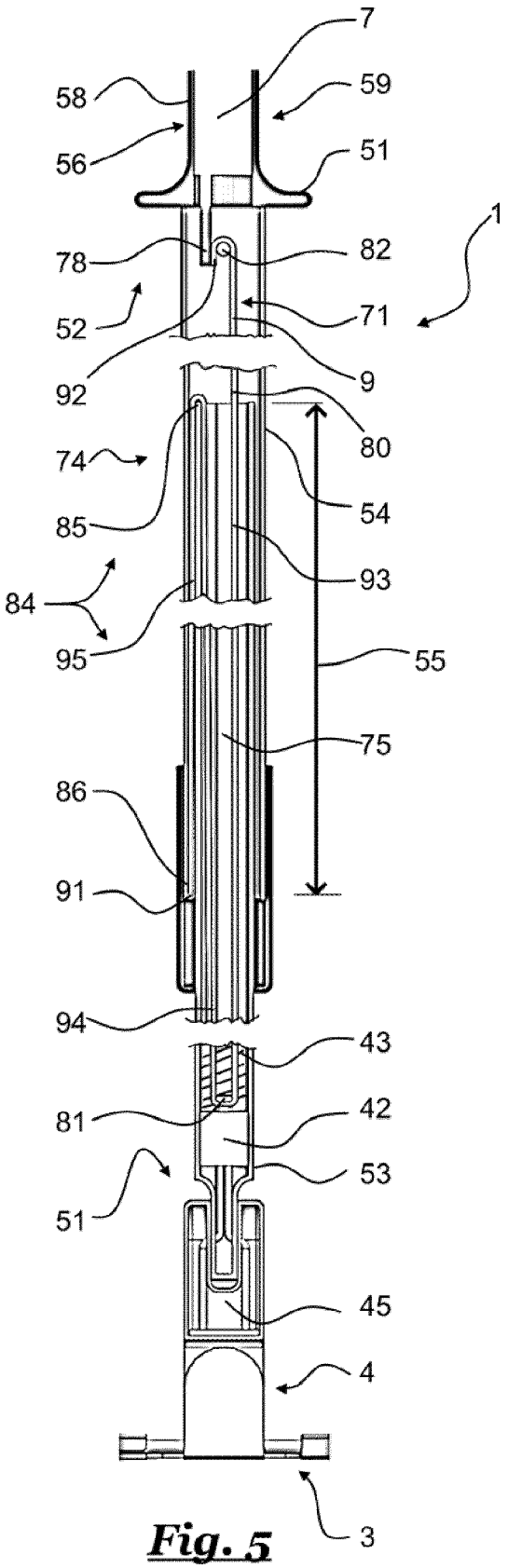
FIG. 5 shows a schematic sectional view of the mop system.

In the exemplary embodiment of a mop system 1, which is shown in FIG. 5, the transmission mechanism 71 for transmitting the activating force and/or movement from the actuating member 7 to the actuating kinematic system 31 is a cable pull 80. The cable pull 80 connects the actuating member 7 on the handle 59 to the actuating kinematic system 31 on the mop holder 3.

The cable pull 80 comprises a pull cable 9. A first end 91 of the pull cable 9 is fastened to the mop handle 5 at a distance from the first end 51 of the mop handle 5. At the lower end 51 of the mop handle, the cable pull 80 is guided around a first, lower deflection mechanism 81. When the cable pull 80 is triggered, the cable pull 80 pulls the lower deflection mechanism 81 translationally away from the lower end 51 in the direction of the longitudinal axis A of the mop handle 5. At the lower end 51 of the mop handle 5, a sliding block 42 is mounted in an inner cavity 75 of the mop handle 5 translationally corresponding to the direction of the longitudinal axis A of the mop handle 5. The lower deflection mechanism 81 is fastened to the sliding block 42 so that the deflection mechanism 81 and the sliding block 42 carry out the same translational movement. The sliding block 42 can be provided with a return spring 43 which forces the sliding block 42 into its lower rest position. When the actuating member 7 is not triggered, for example after completion of a mop cover dropping operation, the return spring 43 forces the sliding block 42 towards the first end 51 of the mop handle 5.

At the upper end 52 of the mop handle 5, the cable pull 80 is connected to the actuating member 7. The actuating member 7 can comprise a fastening mandrel 78 which projects in the longitudinal direction into the inner cavity 75 of the mop handle 5. A second end 92 of the pull cable 9 can be connected to the fastening mandrel 78. The cable pull 80 is guided at the upper end 52 of the mop handle 5 around a second, upper deflection mechanism 82. The second deflection mechanism 82 is arranged in a fixed manner at the upper end 52.

When the push button 70 is pressed, the fastening mandrel 78 moves downwards together with the end 92 of the pull cable 9 in the longitudinal direction. A central pull cable section 93 is pulled upwards by the deflection of the pull cable 9 around the upper deflection mechanism 82. The central pull cable section 93 can extend to the lower deflection mechanism 81 at the sliding block 42. After the deflection of the pull cable 9 at the lower deflection mechanism 81 a further pull cable section 94 follows which leads to the fastened first end 91 of the pull cable 9.

In the embodiment shown here, the mop handle 5 is formed from two telescopic mop handle sections 53, 54. The mop handle sections 53, 54 are formed by tubular hollow bodies. The mop handle sections 53 and 54 can comprise or consist of, for example, plastic fiber reinforced plastic. In the illustrated embodiment, the upper mop handle section 54 has a larger diameter than the lower mop handle section 53 which is inserted in the upper mop handle section 54. There are various possibilities known to the person skilled in the art for fixing a telescopic position of the mop handle 5 selected by the cleaning personnel, which will not be discussed in more detail here.

So that the actuating kinematic system 31 can be activated by the actuating member 7 independently of the telescopic position of the mop handle 5, the mop system 1 in the embodiment illustrated in FIG. 5 is equipped with a length compensation device 74 for the cable pull 80 1. The length compensation device 74 can be realized as illustrated by a cable pull center runner 84. The cable pull center runner 84 is formed by a further deflection mechanism 85 at the end of the inner mop handle section 53 arranged within the outer mop handle section 54 and a fastening 86 of the first end 91 of the pull cable 9 to the end of the outer mop handle section 54, which surrounds the inner mop handle section 53. The pull cable section 94 coming from the first deflection mechanism 81 is guided along the further deflection mechanism 85 so that a compensation section 95 of the pull cable 9 extends from the further deflection mechanism 85 to the fastening 86. The length of the compensation section 95 always corresponds to the length 55 of the inner mop handle section 53 inserted into the outer mop handle section 54.

The mop handle 5 can be firmly or releasably connected to the mop holder 3. An example of a releasable actuating coupling 41 for connecting the mop handle 5 to the mop holder 3 is shown by way of example in FIGS. 7*a* to 7*f*. In the exemplary embodiment illustrated, the actuating coupling 41 is formed as a part of the articulated connection 4 between the mop handle 5 and the flat mop holder 3, which will be discussed in more detail below.

Figure 7E:
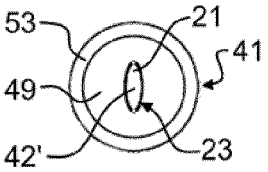
FIG. 7*e* shows a sectional view corresponding to the section line E-E in FIG. 7*b;*
Figure 7F:
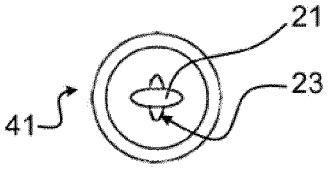
FIG. 7*f* shows a sectional view corresponding to the section line F-F in FIG. 7*c.*
Figure 7A:
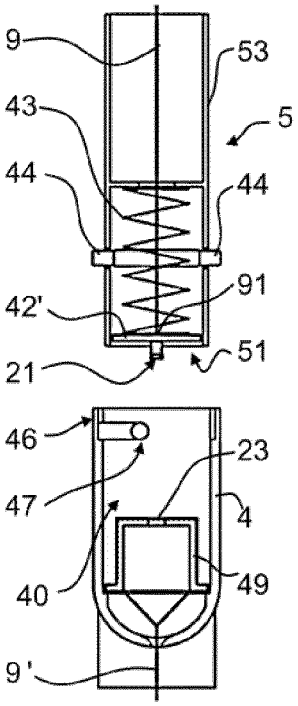
FIG. 7*a* shows a detailed section of a released articulated connection.

FIG. 7*a* shows a mop handle 5 separated from the articulated connection 4. For the sake of simplicity, FIGS. 7*a* to 7*f* show a mop handle 5 of constant length. The first end 91 of the pull cable 9 is fastened to a coupling plate 42' which is held by a return spring 43 at the lower, first end 51 of the mop handle 5. The person skilled in the art will understand that a sliding block 42 as described above or the like could be provided instead of the coupling plate 42'.

Figure 7B:
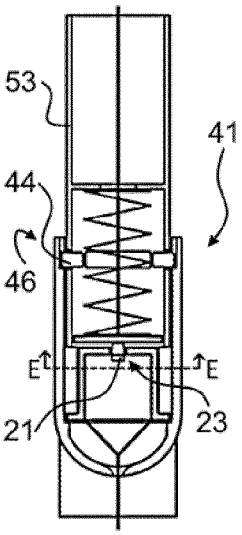
FIG. 7*b* shows a detailed section of the articulated connection according to FIG. 7*a* with inserted mop handle.

At the lower end region of the mop handle-side part of a snap-in connection 44, a latching pin 44 oriented and pretensioned transversely to the longitudinal direction of the mop handle 5 is provided. As can be seen in FIG. 7*a* or 7*b*, two latching pins 44 lying opposite one another in the transverse direction and pretensioned relative to one another can be provided.

Figure 7C:
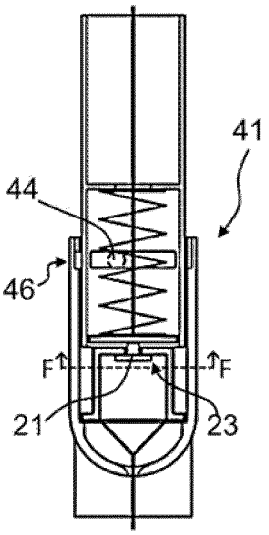
FIG. 7*c* shows a detailed section of the articulated connection according to FIG. 7*a* with latched in mop handle.

A counterpart of the snap-in connection 46, 47 formed complementarily to the mop handle 5 is provided in a receptacle of the articulated connection 4. A latching receptacle 47 which is complementary in shape to the latching pin 44 is provided on the articulated connection 4. The latching pin 44 can be retracted into the mop handle 5 by exerting a pressure in the transverse direction, with the result that the mop handle 5 can be inserted into the receptacle 40 of the articulated connection 4. In that the latching pins 44 are arranged corresponding to the latching receptacles 47, a connection which is complementary in shape is provided between the mop handle 5 and the articulated connection 4, with the result that the mop handle 5 is fastened securely in the articulated connection 4. In addition, the articulated connection has an L-shaped slotted guide 46 into which the latching pin 44 is first introduced translationally corresponding to the mop handle longitudinal direction and is then moved in the circumferential direction with respect to the longitudinal axis A of the mop handle 5. The L-shaped slotted guide 46 on the articulated connection 4 together with the latching pin 44 forms a bayonet connection. It should be clear that, as an alternative to the embodiment illustrated, a receptacle 40 for a projection of the articulated connection 4 can be provided in the mop handle 5. In addition or alternatively, instead of the embodiment illustrated, a latching pin can be fastened to the articulated connection and an L-shaped slotted guide and/or latching receptacle can be formed on the mop handle 5. FIG. 7*b* shows the mop handle 5 inserted translationally into the receptacle 40 of the articulated connection 4. FIG. 7*c* shows the latched-in mop handle 5 after insertion and rotation in the bayonet slotted guide in the articulated receptacle 40.

Figure 7D:
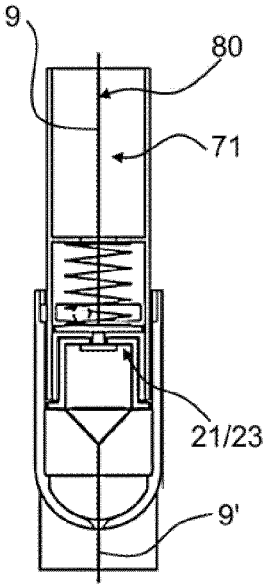
FIG. 7*d* shows a detailed section of the articulated connection according to FIG. 7*a* with actuated cable pull and transmission coupling.

FIG. 7*d* shows the latched-in mop handle 5 with activated transmission mechanism 71. The cable pull 80 is tightened by the actuation of the actuating member, so that the coupling plate 42' is raised counter to the force of the return spring 43. The actuating coupling 41 comprises a coupling part 49 which is arranged within the articulated connection 4 and interacts with the coupling plate 42' (or another corresponding component, such as a sliding block 42) in order to transmit the actuating movement and/or force from the actuating member 7 to the actuating kinematic system 31.

In the embodiment illustrated in FIGS. 7*a* to 7*f*, the actuating coupling 41 comprises on the one hand an engagement lug 21 and on the other hand a lug receptacle 23 corresponding thereto. As can be seen in FIGS. 7*b* and 7*e*, the engagement lug 21 can be inserted into the lug receptacle 23 in the longitudinal direction. After the rotation of the mop handle 5 relative to the receptacle 40, the engagement lug 21 is held fast in the longitudinal direction by the lug receptacle 23. When the engagement lug 21 is held in the lug receptacle 23, the coupling plate 42' and the coupling part 49 move together. The activating movement and/or force is transmitted from the actuating member 7 to the actuating kinematic system 31 by the common movement of coupling plate 42' and coupling part 49. The person skilled in the art will understand that a wide variety of other force-fit and/or form-fit couplings can be used instead of the engagement lug/lug receptacle coupling illustrated as an exemplary actuating coupling 41.

FIGS. 3*a* and 3*b* show in detail the actuating kinematic system 31 and an exemplary articulated connection 4, which is formed here as a pivot-tilt joint. The articulated connection 4 allows the mop handle 5 to move relative to the mop holder 3 about a tilt axis K and an axis of rotation D oriented transversely, in some cases orthogonally, to the tilt axis K. The pull cable 9" extends into the flat mop holder 3 through the pivot-tilt joint 4. The remaining transmission mechanism 71 arranged in the mop handle 5, which can be configured as a cable pull, is not illustrated in FIGS. 3*a* and 3*b* for the sake of simplicity.

It should be clear that, in an embodiment of a mop system which is not separable from the flat mop holder 3 or the articulated connection 4, respectively, the pull cable 9" can be formed in functional union with the (first) pull cable 9 within the mop handle 5. In an embodiment of a mop system 1 with a mop handle 5 releasable from the flat mop holder 3 for example according to FIG. 7*a*, the pull cable 9 or another transmission mechanism 71 in the mop handle 5 can be formed by a component separate from the pull cable 9", such as the pull cable 9' illustrated in FIG. 7*a*.

In the articulated connection 4, the mop handle 5 is movable relative to the mop holder 3 about a first axis, here a tilt axis K, about a tilt inclination γ. The articulated connection 4 is preferably configured and arranged in such a manner that the mop handle 5 can be tilted relative to a vertical basic position in both directions relative to the tilt axis K about a tilt inclination γ of at least 60°, in some cases at least 80°, preferably about 90°. The tilt axis K is arranged at the mop handle-side end of the articulated connection 4.

In the articulated connection 4, the mop handle 5 is movable relative to the mop holder 3 about a second axis, here an axis of rotation D, about a pivot inclination δ. The articulated connection 4 is preferably configured and arranged in such a manner that the mop handle 5 can be rotated relative to a vertical basic position in both directions relative to the axis of rotation D about a pivot inclination δ of at least 60°, in some cases at least 80°, preferably about 90°. The axis of rotation D is arranged at the mop holder-side end of the articulated connection 4. The direction of the axis of rotation D corresponds to the direction of the linear movability of the latch 33. The latch 33 is coaxial to the axis of rotation D. The pull cable 9" is connected to a lever 35 of the actuating kinematic system 31 in a force-transmitting manner which transmits the actuating force and/or movement from the cable pull 80 to the latch 33 in order to activate the actuating kinematic system 31. When the pull cable 9" is pulled in the direction of the mop handle 5, this causes a pivoting of the lever 35, as a result of which the latch 33 is moved away from the recess 34, such that the locking of the flat mop holder 3 is released.

The latch 33 is forced in the direction of the recess 34 by a spring 37. When the actuating kinematic system 31 is not activated by the pull cable 9", the spring 37 presses the latch into the recess 34, such that the flat mop holder 3 is held in its first state.

The pull cable 9" is introduced into the articulated connection 4 centrally, preferably coaxially, corresponding to the direction of the longitudinal axis A in the case of a vertical orientation of the mop handle 5. The articulated connection 4 has an angle compensation device 73 which causes the pull cable 9" to be reliably guided to the actuating kinematic system 31 independently of the tilt inclination γ of the mop handle 5. In the exemplary embodiment illustrated in FIG. 3*b*, the angle compensation device 73 is formed by a pull cable support curve 83 on the articulated connection 4. When the mop handle 5 is set about the tilt axis K with a tilt inclination γ (not illustrated in more detail), the pull cable 9" is guided along the support curve 83. A section of the support curve 83 guides the pull cable 9" in a tunnel-like manner centrally and coaxially along an articulated axis G of the pivot-tilt joint, to which the tilt axis K and the axis of rotation D are oriented orthogonally. Another section of the support curve 83 forms a rounded sliding curve, along which the pull cable 9" is laterally supported in the case of a tilt inclination. The guide along the support curve 83 ensures that the lower end 91" of the pull cable 9" is not unintentionally displaced as a result of the tilt inclination γ, but is held in a stationary fixed manner with respect to the actuating kinematic system 31. With the aid of the support curve 83, it is ensured that, independently of the tilt inclination γ of the mop handle 5 in relation to the mop holder 3, activation of the actuating kinematic system 31 can be brought about exclusively with the actuating member 7.

Figure 8:
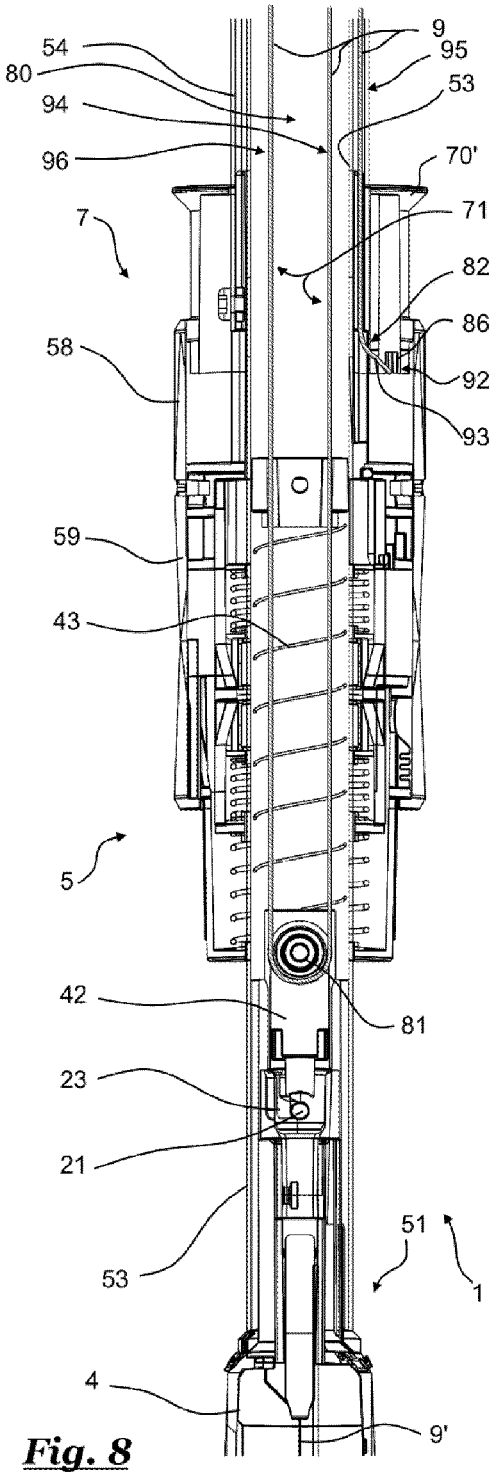
FIG. 8 shows a sectional view of an alternative embodiment of a mop handle with handle and actuating sleeve.
Figure 9:
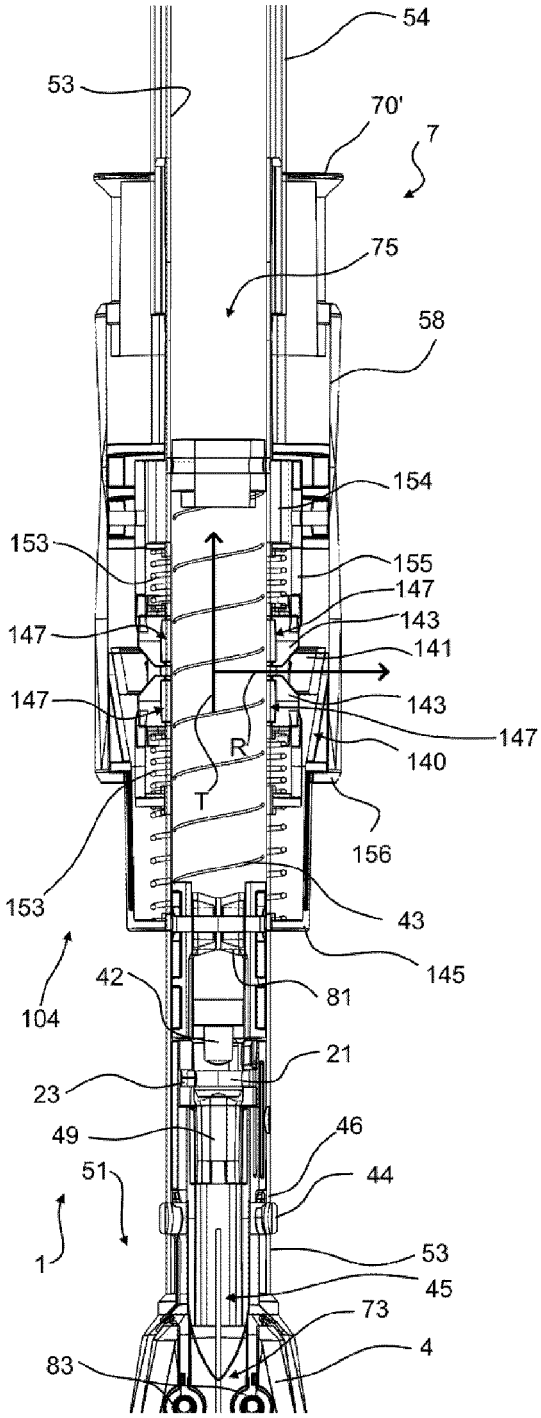
FIG. 9 shows another sectional view of the mop handle according to FIG. 8.
Figure 10:
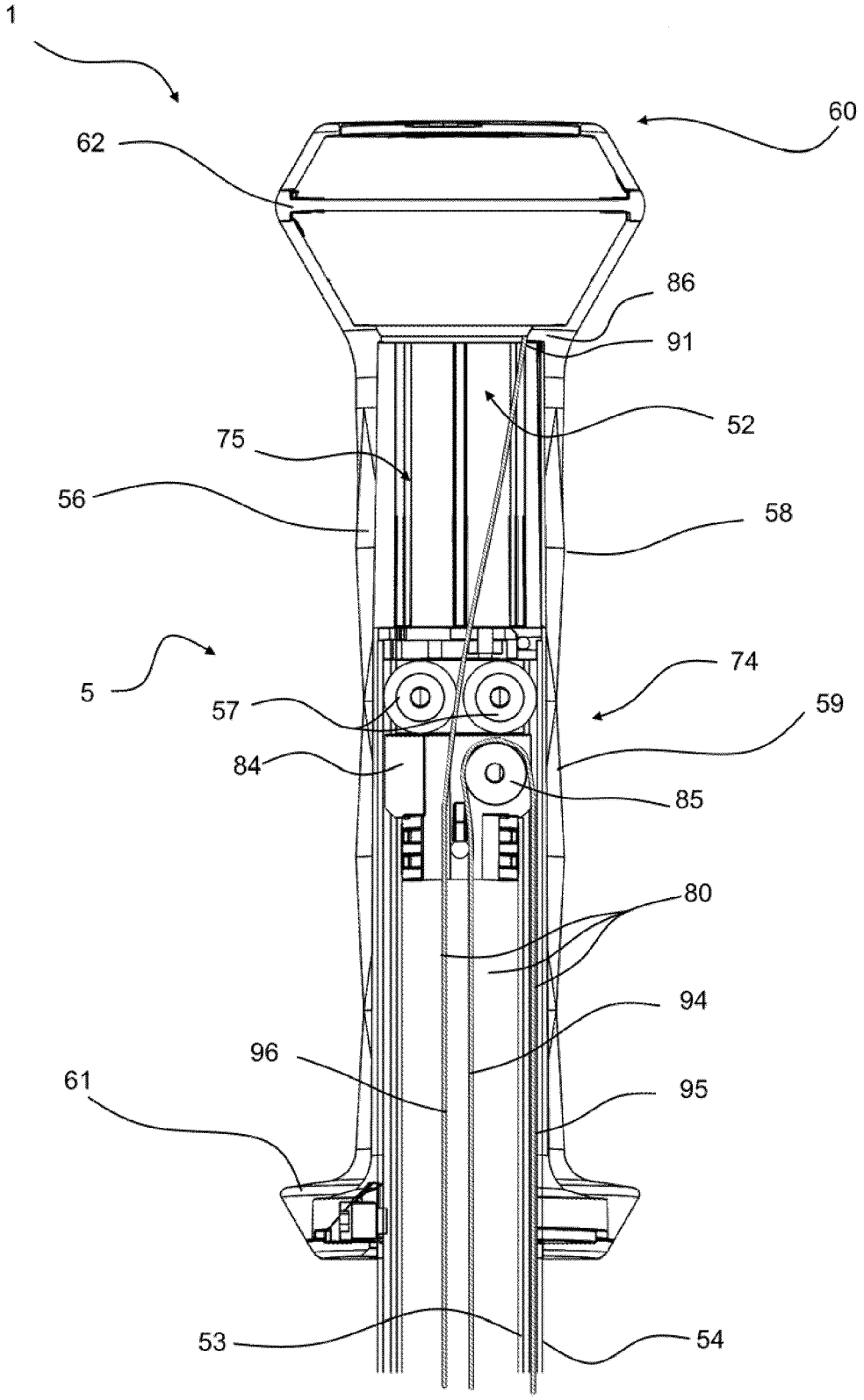
FIG. 10 shows a sectional view of the second end section of the mop handle according to FIG. 8.

FIGS. 8 to 10 show an alternative embodiment of the cleaning mop 1 with a differently realized actuating member 7. In comparison with the embodiments described above, a difference substantially only consists in that the actuating member 7 is arranged at the lower end of the upper mop handle section 54. A further difference consists in the alternative embodiment, illustrated in FIGS. 8 and 9, of the coupling of the mop handle 5 to the flat mop holder 3, the functioning of which substantially corresponds to that described in relation to FIGS. *7a* to *7e*.

The actuating member 7 comprises, as actuating mechanism, a push button in the form of a pressure sleeve 70'. The pressure sleeve 70' is mounted movably on a support section 154 which is firmly connected to the lower end of the upper mop handle section 54. The pressure sleeve 70' is forced into the passive position shown in FIGS. 8 and 9 by a compression spring (not illustrated in more detail). A fastening 86 for the second end 92 of the pull cable 9 is arranged on the pressure sleeve 70'.

An actuating force exerted on the pressure sleeve 70' is transmitted via the cable pull 80 to the coupling in the region of the articulated connection 4 and from there to the actuating kinematic system 31 of the flat mop holder 3 in order to release a mop cover 2.

As in the case of the above embodiment, the cable pull 80 of the mop handle 5 in FIGS. 8-10 also comprises a length compensation device 74. The cable pull 80 is initially guided from the fastening 86 at the second end 92 of the pull cable 9 along a first pull cable section 93 to a second deflection mechanism 82. The second deflection mechanism can be referred to as an insertion deflection mechanism 82. The insertion deflection mechanism 82 is adapted and arranged to guide the pull cable 9 securely into a circumferential cavity between the inner mop handle section 53 and the outer mop handle section 54. A first compensation section 95 of the pull cable runs in the circumferential cavity from the second deflection mechanism 82 to a further deflection mechanism 85. The further deflection mechanism 85 can be referred to as a second insertion deflection mechanism 85. The second insertion deflection mechanism 85 is also adapted and arranged to guide the pull cable 9 securely into the circumferential cavity between the inner mop handle section 53 and the outer mop handle section 54.

The pull cable 9 runs from the further deflection mechanism 85 into an inner cavity 75 of the mop handle 5 to a first deflection mechanism 81. The first deflection mechanism 81 is arranged in the region of the first end 51 of the mop handle 5. The first deflection mechanism 81 is connected rotatably and in a force-fitting manner to the sliding block 42 of the coupling described below. A second compensation section 96 of the pull cable 9 runs from the first deflection mechanism 81 to a further fastening 86 of the first end 91 of the pull cable 9 at the upper end 52 of the upper mop handle section 54. When the actuating device 7 is activated, the first deflection mechanism 81 is raised together with the sliding block 42.

An engagement lug 21 is fastened to the sliding block 42. The engagement lug 21 is adapted and arranged to cooperate with a lug receptacle 23 in a coupling part 49. The sliding block 42 is part of the mop handle 5 and the coupling part 49 is connected to the articulated connection 4 and the flat mop holder 3. A further pull cable 9', which is connected to the actuating kinematic system 31, is attached to the coupling part 49. The coupling part 49 and the sliding block 42 are releasably connected to one another.

In the embodiment illustrated here, the articulated connection 4 is provided with a snap-in connection 44 in the form of a latching hook which is pretensioned outward in the radial direction R. At the lower end 51 of the lower mop handle section 53, a receptacle 46, which cooperates with the hook 44, is provided as a corresponding snap-in connection 46.

FIGS. 8 and 9 further show an optional locking device 104. A sliding block 84, with which the inner mop handle section 53 is guided in the outer mop handle section 54, is fastened to the upper end of the inner mop handle section 53. Additionally or alternatively, two diametrically opposite guide rollers 57, with which the inner mop handle section 53 rolls on the inside on the outer mop handle section 54, are arranged at the upper end of the inner mop handle 53. In the illustrated embodiment, the outer mop handle section 54 has an octagonal cross-sectional shape and the inner mop handle section 53 has a circular cross-sectional shape.

A support section 154, 156 is rigidly fastened to the lower end of the upper, outer mop handle section 54. An actuating sleeve 145 is mounted movably in the translation direction T on the support section 154. The actuating sleeve 145 is arranged at the lower end of the locking device 104. The actuating sleeve 145 is forced into the position illustrated in the figures by a spring. The position can be referred to as a stop position because the holding members 143 are in contact engagement with the inner mop handle section 53 in this position.

The holding members 143 are forced against oblique wedge surfaces 146 by pretensioning mechanism 153, wherein the oblique wedge surfaces 146 force the holding members 143 against the inner mop handle section 53 in the radial direction R. The wedge surfaces 146 are formed on the sliding wedge 141 which is arranged between the holding members 143 in the translation direction T and is supported on the outside on a conical sliding surface 140 in the radial direction. The sliding surface 140 is connected to the actuating sleeve 145.

The actuating sleeve 145 of the first locking device 104 can be displaced in the translation direction T counter to the force of the spring. The sliding surface 140 is firmly connected to the actuating sleeve 145 and carries out the same movement as the actuating sleeve 145. When the conical sliding surface 140 moves upwards in the translation direction T, the sliding surface 140 forces the sliding wedge 141 inwards in the radial direction R. The holding members 143 then slide along the wedge surfaces 146 of the sliding wedge 141 in the translation direction T counter to their pretensioning mechanism 153 and thereby release the inner mop handle section 53.

The locking device 104 comprises two compression springs 153 lying opposite one another in the longitudinal direction T as pretensioning mechanism. The upper compression spring 153 is supported on the support section 154 in the longitudinal direction T and brings about a pretensioning force directed downwards corresponding to the longitudinal direction T on the upper pair of holding members 143. At the lower end of the multi-purpose sleeve 155, a plate-like second support section 156 is provided, on which the lower compression spring 153 is supported in the longitudinal direction T. The lower compression spring 153 brings about a pretensioning force directed upwards corresponding to the longitudinal direction on the lower pair of holding members 143. The compression springs 153 force the holding members 143 respectively assigned to them in the longitudinal direction T against the respective wedge surface 146. The spring force acting on the holding members 143 in the longitudinal direction forces the holding members 143 along the wedge surface 146 inwards in the radial direction R against the inner mop handle section 53. In the holding position, the holding members 143 are forced against the inner mop handle section 53 in such a manner that a force-fitting connection is realized between the outer mop handle section 54 and the inner mop handle section 53. The force-fitting connection can be realized by a gripping coating 147 arranged on the respective inner surface of the holding members 143. Here, the gripping coating forms with the outer side of the inner mop handle section 53 an adhesive pairing with a high coefficient of static friction. The gripping coating is preferably elastic or rubber-elastic. Preferably, the gripping coating comprises or consists of a thermoplastic elastomer (TPE) material. Suitable TPE materials can be selected from the group consisting of thermoplastic elastomers based on olefin (TPO), thermoplastic polyamide elastomers (TPA), thermoplastic copolyester elastomers (TPC), thermoplastic styrene block copolymers (e.g., SBS, SEBS, SEPS, SEEPS and MBS), thermoplastic elastomers based on urethane (TPU) and thermoplastic vulcanizates or cross-linked thermoplastic elastomers based on olefin (TPV). Thermoplastic elastomers based on urethane (TPU) are particularly preferably used. In some cases, particularly long-lived products are obtained with the latter which retain their functionality in relation to the force-fitting connection without restriction even after a large number of autoclaving cycles. The gripping coating can be fastened, for example injection-molded, to a support body of the holding member 143. The support body can be manufactured from or comprise, respectively, or consist of a thermosetting or a thermoplastic material, such as PEEK, PEI, POM and/or PPSU. If a thermoplastic material is used for the support body, gripping coating and support body can preferably also be obtained by way of 2K injection molding. To release the force-fitting connection, the sliding wedge 141 in the start position of the actuating part 145 forces between the holding members 143 adjacent in the longitudinal direction T and forces them apart in the longitudinal direction T counter to the force of the compression spring 153. Due to the fact that the sliding wedge 141 forces the holding members 143 out of the holding position in the longitudinal direction T, the holding members 143 reach a release position remote from the mop handle section 53 in the radial direction R. If the holding members 143 are forced away from the mop handle section 53 by the sliding wedge 151, the force-fitting connection is released and the inner mop handle section 53 is freely telescopically movable in the longitudinal direction T with respect to the outer mop handle section 54 (not illustrated in more detail).

The features of the disclosure disclosed in the preceding description, in the claims and in the drawings can be essential both individually and in any desired combination for the realization of the disclosure in its various embodiments.

REFERENCE SIGNS

1 Cleaning Mop
2 Mop Cover
3 Flat Mop Holder
4 Articulated Connection
5 Mop Handle
7 Actuating member
9, 9', 9" Pull cable
21 engagement lug
23 lug receptacle
30, 32 mop holding wings
31 actuating kinematic system
33 latch
34 recess
35 lever
36 flange section
37 spring
40 receptacle
41 actuating coupling
42 sliding block
42' coupling plate
43 return spring
44, 46, 47 snap-in connection
45 articulation interior
49 coupling part
51 first end
52 second end
53, 54 mop handle sections
55 length
56 grip section
57 guide roller
58, 60 rounded outer contour
59 handle
61 shield
62 knob
63 resetting spring
70 push button
70 pressure sleeve
71 transmission mechanism
73 angle compensation device
74 length compensation device
75 inner cavity
78 fastening mandrel
80 cable pull
81 first deflection mechanism
82 second deflection mechanism
83 pull cable support curve
84 cable pull center runner
85 further deflection mechanism
86 fastening
91, 91" first end
92 second end
93, 94 pull cable section
95, 96 compensation section
104 locking device
140 sliding surface
141 sliding wedge
143 holding member
144 counter stop
145 actuating sleeve
146 wedge surfaces
147 gripping coating
153 pretensioning mechanism
154, 156 support section
155 multi-purpose sleeve
δ pivot inclination
γ tilt inclination
A longitudinal axis
D axis of rotation
G articulation axis
K tilt axis
R radial direction
T transverse direction The various embodiments described above can be combined to provide further embodiments. All of the patents, patent applications, and non-patent publications referred to in this specification and/or listed in the Application Data Sheet are incorporated herein by reference, in their entirety. Aspects of the embodiments can be modified, if necessary to employ concepts of the various patents, applications, and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A mop system, comprising:

a flat mop holder which is adapted and arranged to hold a mop cover in a first state and to release the mop cover in a second state, and which comprises an actuating kinematic system for causing a change from the first state to the second state, and a mop handle which is connected or connectable to the flat mop holder at a first end, wherein an actuating member is arranged opposite to the first end on the mop handle, at a second end of the mop handle, which is adapted and arranged to activate the actuating kinematic system, at least one cable pull which is adapted and arranged to transmit an activating force and/or movement from the actuating member to the actuating kinematic system, and wherein the mop handle comprises a plurality of mop handle sections which are telescopically adjustable relative to one another, wherein the at least one cable pull comprises at least one length compensation device which is adapted and arranged to variably adjust the at least one cable pull corresponding to a telescopic position of the mop handle sections.

2. The mop system (1) according to claim 1, wherein the actuating kinematic system has at least one first mop holding wing which is pivotable relative to at least one second mop holding wing, wherein the first and second mop holding wings are adapted and arranged to clamp the mop cover in a plane in the first state.

3. The mop system according to claim 1, wherein the mop system comprises at least one retracted configuration in which the mop system has a minimum telescopic length, and wherein the mop system has at least one extended configuration in which the mop handle is extended to a maximum telescopic length.

4. The mop system according to claim 1, wherein the mop system has a total weight in a range of 400 g to 800 g.

5. The mop system according to claim 1, wherein the at least one cable pull comprises at least one pull cable and at least one deflection mechanism, wherein the at least one cable pull comprises a first pull cable which extends from the first end to the actuating member at the opposite second end.

6. The mop system according to claim 5, wherein the at least one length compensation device comprises a cable pull center runner which comprises a deflection mechanism fastened to the end of an inner mop handle section, which adjusts a compensation length of the at least one pull cable between the deflection mechanism and a first end of the at least one pull cable corresponding to an inserted length of the inner mop handle section within an outer mop handle section.

7. The mop system according to claim 5, further comprising an articulated connection by way of which the first end of the mop handle is connected or connectable to the flat mop holder, wherein the articulated connection has a releasable actuating coupling which connects the actuating member to the actuating kinematic system in a force-transmitting manner, wherein the at least one cable pull further comprises a second pull cable which extends in the mop holder and the articulated connection and/or connects an actuating coupling to the actuating kinematic system in a force-transmitting manner, wherein the actuating coupling comprises at least one deflection mechanism which is arranged at a first handle end and cooperates with the first pull cable and which carries a coupling plate or a sliding block, wherein a return spring forces the sliding block or the coupling plate in a direction of the first handle end, wherein the articulated connection comprises a coupling part which is connected to the actuating kinematic system by way of the second pull cable on the one hand and which is connected or connectable to the coupling plate or sliding block in a releasable manner on the other hand, in order to transmit the actuating force and/or movement from the actuating member to the actuating kinematic system, and/or wherein the actuating coupling is arranged in an articulation interior.

8. The mop system according to claim 5, wherein:

(a) the flat mop holder and/or the mop handle comprises a plastic material, (b) the flat mop holder and/or the mop handle comprises carbon fiber reinforced plastic, (c) the at least one pull cable comprises a liquid crystalline polymer, and/or (d) the mop system comprises at least one movable component, stainless steel, and/or silicone, wherein the mop system is heat resistant up to at least 100° C.

9. The mop system according to claim 1, further comprising an articulated connection by way of which the first end of the mop handle is connected or connectable to the flat mop holder, wherein the articulated connection has a releasable actuating coupling which connects the actuating member to the actuating kinematic system in a force-transmitting manner.

10. The mop system according to claim 9, wherein the articulated connection comprises a snap-in connection which is adapted and arranged to connect the mop handle to the flat mop holder in a releasable manner.

11. The mop system according to claim 1, wherein the actuating member comprises a push button which is arranged on a handle of the mop handle, wherein the push button is connected to a second end of the pull cable, and wherein a deflection mechanism is arranged in a region of the push button.

12. The mop system in particular according to claim 1, wherein:

the flat mop holder is adapted and arranged to hold the mop cover in the first state and to release the mop cover in the second state, and which comprises an actuating kinematic system for causing a change from the first state to the second state, a mop handle which is connected or connectable to the flat mop holder at the first end, wherein the actuating kinematic system comprises at least two mop holding wings which are pivotable relative to one another, and wherein an actuating member is arranged opposite the first end on the mop handle.

13. The mop system according to one claim 1, wherein the actuating kinematic system comprises at least one mechanical latch and/or a rotationally movable rotary latch.

14. The mop system according to claim 1, further comprising a magnetic force coupling between the actuating member and the actuating kinematic system, wherein the actuating kinematic system comprises the magnetic force coupling.

15. A kit of parts, comprising:

a mop system according to claim 1, and a flat mop cover.

* * * * *